US010038293B2

(12) United States Patent
Stoner

(10) Patent No.: US 10,038,293 B2
(45) Date of Patent: Jul. 31, 2018

(54) METHOD OF MAKING ELECTRICAL CONTACT WITH CONTACT AREA GEOMETRY ENLARGEMENT

(71) Applicant: FCI USA LLC, Etters, PA (US)

(72) Inventor: Stuart C. Stoner, Lewisberry, PA (US)

(73) Assignee: FCI USA LLC, Etters, PA (US)

( * ) Notice: Subject to any disclaimer, the term of this patent is extended or adjusted under 35 U.S.C. 154(b) by 194 days.

(21) Appl. No.: 14/957,730

(22) Filed: Dec. 3, 2015

(65) Prior Publication Data

US 2016/0087388 A1 Mar. 24, 2016

Related U.S. Application Data

(62) Division of application No. 13/442,215, filed on Apr. 9, 2012, now Pat. No. 9,231,325.

(60) Provisional application No. 61/490,303, filed on May 26, 2011.

(51) Int. Cl.

| | |
|---|---|
| ***H01R 13/05*** | (2006.01) |
| ***H01R 43/16*** | (2006.01) |
| ***H01R 11/11*** | (2006.01) |
| *H01R 13/6587* | (2011.01) |

(52) U.S. Cl.

CPC ..... *H01R 43/16* (2013.01); *H01R 11/11* (2013.01); *H01R 13/05* (2013.01); *H01R 13/6587* (2013.01); *Y10T 29/49147* (2015.01)

(58) Field of Classification Search

CPC .... H01R 11/11; H01R 13/05; H01R 13/6587; H01R 43/16; Y10T 29/49147

See application file for complete search history.

(56) References Cited

U.S. PATENT DOCUMENTS

| | | | | |
|---|---|---|---|---|
| 2,183,067 | A | 12/1939 | Gardner | 439/751 |
| 2,542,609 | A | 2/1951 | Wyglendowski | 173/361 |
| 5,135,414 | A | 8/1992 | Van Dijk | 439/692 |
| 5,284,447 | A | 2/1994 | Kristiansen | 439/425 |
| 5,823,830 | A | 10/1998 | Wurster | 439/751 |
| 6,299,492 | B1 * | 10/2001 | Pierini | H01R 13/26 439/884 |
| 6,402,566 | B1 | 6/2002 | Middlehurst et al. | 439/699.1 |
| 6,524,129 | B2 | 2/2003 | Cote et al. | 439/511 |
| 6,659,813 | B2 * | 12/2003 | Sai | H01R 43/007 439/884 |
| 6,767,226 | B2 | 7/2004 | Varatta | 439/106 |
| 6,869,292 | B2 | 3/2005 | Johnescu et al. | 439/74 |
| 7,131,870 | B2 | 11/2006 | Whiteman et al. | 439/607.06 |

(Continued)

*Primary Examiner* — Minh Trinh

(74) *Attorney, Agent, or Firm* — Wolf, Greenfield & Sacks, P.C.

(57) ABSTRACT

A method including providing a contact lead frame comprised of a sheet metal member, where the contact lead frame includes a plurality of first signal contacts and a plurality of second ground contacts, where the first signal contacts have a male termination end with a first effective thickness which is substantially the same as thickness of the sheet metal member, and stamping a male termination end of the second ground contact, located at a same side of the lead frame as the male termination end of the first signal contacts, to form a dual beam structure having a second effective thickness which is larger than the first effective thickness, where two beams of the dual beam structure are generally parallel to each other along a majority of length of the male termination end of the second ground contact.

4 Claims, 4 Drawing Sheets

(56) References Cited

U.S. PATENT DOCUMENTS

| | | | | |
|---|---|---|---|---|
| 7,332,674 | B2 | 2/2008 | Peterson et al. | 174/74 R |
| 7,524,209 | B2 | 4/2009 | Hull et al. | 439/608 |
| 7,566,247 | B2 | 7/2009 | Rothermel et al. | 439/607.05 |
| 7,585,186 | B2 | 9/2009 | McAlonis et al. | 439/607.05 |
| 9,231,325 | B2 * | 1/2016 | Stoner | H01R 13/05 |
| 2006/0068641 | A1 | 3/2006 | Hull et al. | 439/608 |
| 2007/0207674 | A1 | 9/2007 | Minich | 439/608 |
| 2007/0207675 | A1 | 9/2007 | Minich | 439/608 |
| 2008/0220666 | A1 | 9/2008 | Fedder et al. | 439/862 |
| 2010/0055988 | A1 | 3/2010 | Shuey et al. | 439/660 |

* cited by examiner

METHOD OF MAKING ELECTRICAL CONTACT WITH CONTACT AREA GEOMETRY ENLARGEMENT

CROSS-REFERENCE TO RELATED APPLICATION

This application is a divisional application of co-pending application Ser. No. 13/442,215 filed Apr. 9, 2012, which claims priority under 35 USC 119(e) on U.S. Provisional Patent Application No. 61/490,303 filed May 26, 2011 which are hereby incorporated by reference in their entireties.

BACKGROUND

Technical Field

The exemplary and non-limiting embodiments of the invention relate generally to an electrical contact and, more particularly, to a contact area having a geometry to provide an enlarged area.

Brief Description of Prior Developments

U.S. Pat. No. 7,524,209, which is hereby incorporated by reference in its entirety, discloses an electrical connector having signal and ground contacts. The ground contacts and signal contacts have different widths at their male termination ends to removably mate with a mating electrical connector. The smaller width provided at the male termination end of the signal contacts is provided by reducing, in the forming die, the thickness of the signal blades. The signal contacts are initially provided in the same lead frame as the ground contacts. Material reduction in a die is not tooling friendly, and the material costs are higher than using one consistent thickness. It is also not desired to redesign the mating connector to accommodate changes to contact thickness.

SUMMARY

The following summary is merely intended to be exemplary. The summary is not intended to limit the scope of the claims.

In accordance with one aspect, an electrical contact is provided including a male termination end configured to be removably inserted into a female termination end of a mating contact. The male termination end having a slot between two beam sections. The slot is formed by a section of the male termination end having had material removed between the two beam sections. The two beam sections are outwardly deformed in opposite directions. The two beam sections are substantially parallel to each other along a majority of length of the male termination end.

In accordance with another aspect, an electrical connector is provided comprising a housing; a first signal contact connected to the housing; and a second ground contact connected to the housing. The first signal contact and the second ground contact are comprised from a same sheet material. The first signal contact has a male termination end at a first side of the housing with a first effective thickness substantially the same as thickness of the sheet material. The second ground contact has a male termination end at the first side of the housing with a second effective thickness which is larger than the first effective thickness. The male termination end of the second ground contact comprises two beam sections which are generally parallel to each other.

In accordance with another aspect, a method comprises providing a contact lead frame comprised of a sheet metal member, where the contact lead frame comprises a plurality of first signal contacts and a plurality of second ground contacts, where the first signal contacts have a male termination end with a first effective thickness which is substantially the same as thickness of the sheet metal member, and stamping a male termination end of the second ground contact, located at a same side of the lead frame as the male termination end of the first signal contacts, to form a dual beam structure having a second effective thickness which is larger than the first effective thickness, where two beams of the dual beam structure are generally parallel to each other along a majority of length of the male termination end of the second ground contact.

BRIEF DESCRIPTION OF THE DRAWINGS

The foregoing aspects and other features are explained in the following description, taken in connection with the accompanying drawings, wherein.

DETAILED DESCRIPTION OF EMBODIMENT

Figure 1:
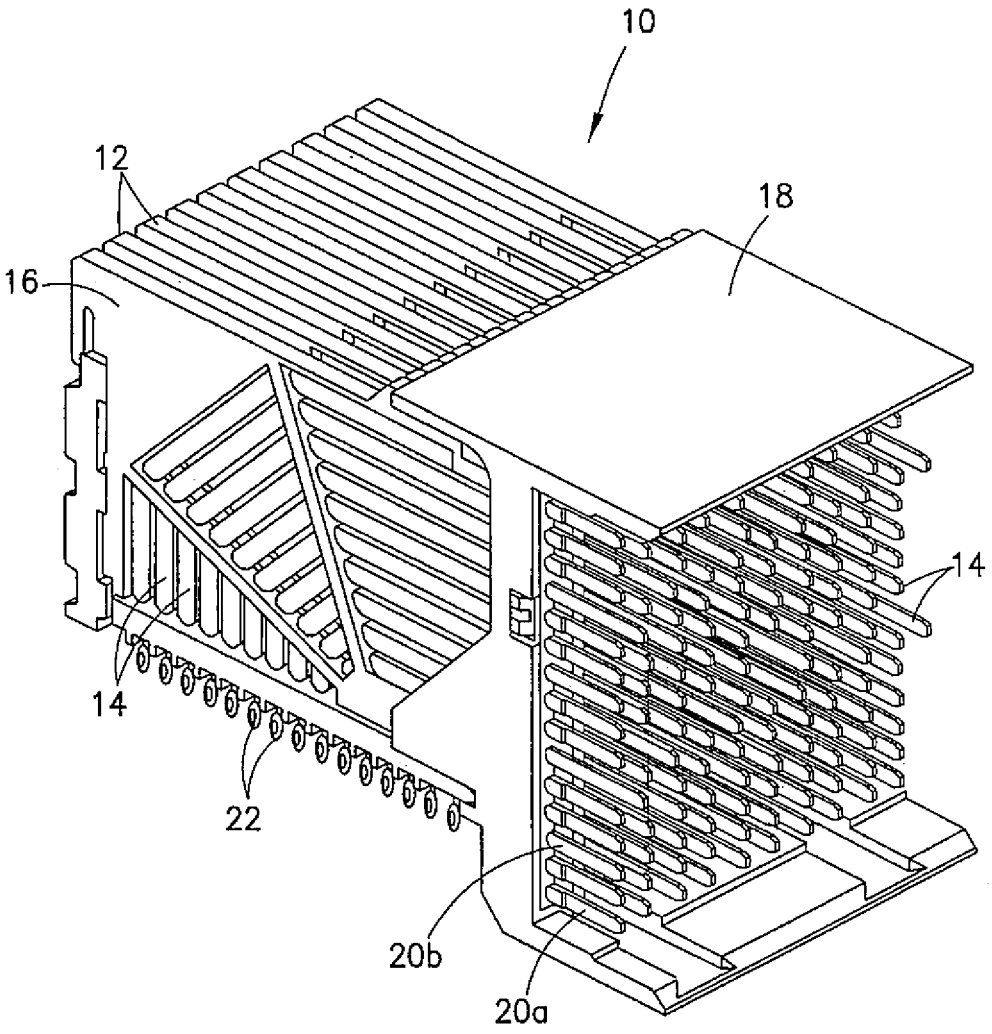
FIG. 1 PRIOR ART
FIG. 1 is a perspective view of a conventional electrical connector.

Referring to FIG. 1, there is shown a perspective view of a conventional electrical connector similar to that described in U.S. Pat. No. 7,524,209. The connector 10 comprises multiple Insert Molded Leadframe Assemblies (IMLAs) 12. Examples of IMLAs are described in U.S. Pat. No. 6,869,292 B2 and U.S. patent publication No. 2010/0055988 A1 which are hereby incorporated by reference in their entireties. The IMLAs 12 each comprise a plurality of the contacts 14 aligned in a row and a plastic overmolded frame 16. The frame 16 keeps the row of contacts 14 together for easy assembly into the housing 18. The contacts 14 comprise two different types of contacts: signal contacts and ground contacts with different respective mating contact ends 20*a*, 20*b*. The male ends 20*a*, 20*b* are configured to removably connect to female ends of contacts in a mating connector 30 (see FIG. 2). The male ends 20*b* of the ground contacts have a thickness of about 0.35 mm. The contacts 14 are made from a sheet metal member having a thickness of about 0.35 mm. The male ends 20*a* of the signal contacts, although made as a same lead frame as the ground contacts, have a thickness of about 0.20 mm due to material reduction in the lead frame forming die. Opposite ends 22 of the contacts 14 are configured to be inserted into holes of a printed circuit board.

Figure 2:
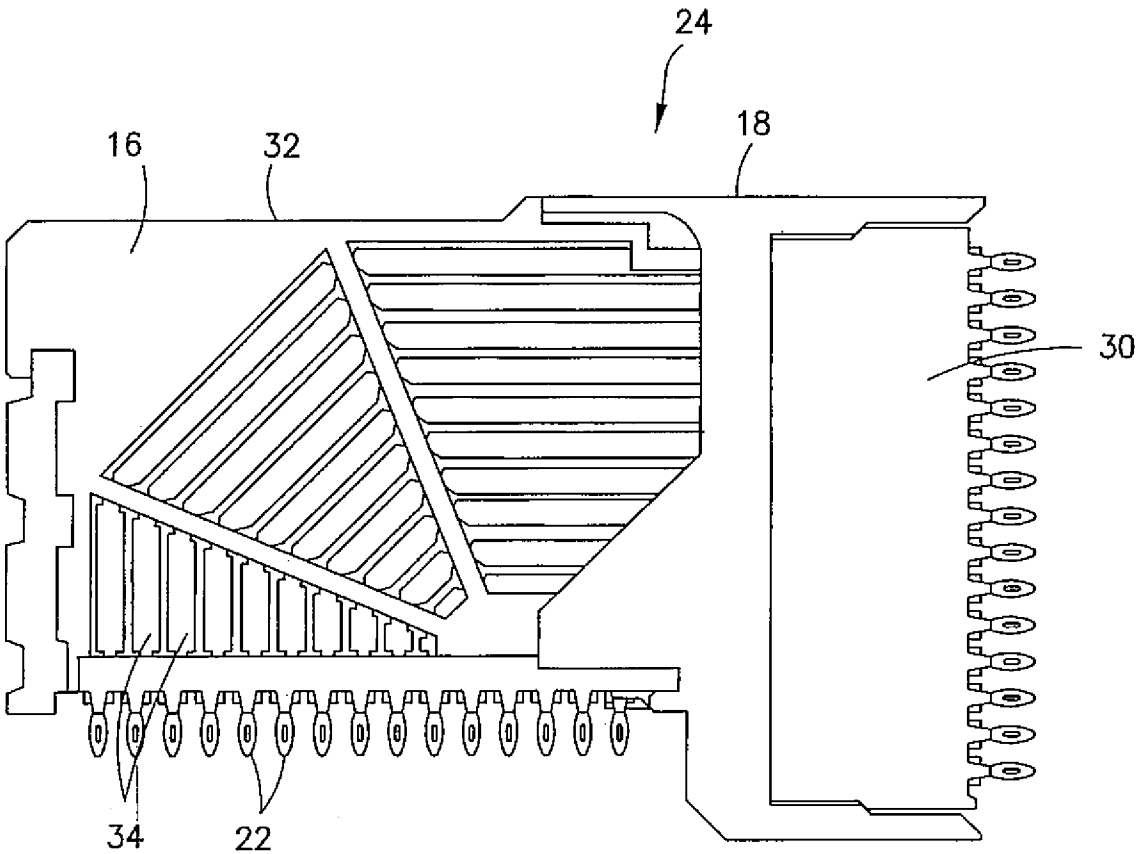
FIG. 2 is a side view of an assembly of two electrical connectors.

Referring now to FIG. 2, an assembly 24 of two electrical connectors is shown. The assembly 24 comprises the mating connector 30, and a connector 10' incorporating features of an example embodiment. Although the features will be described with reference to the example embodiment shown in the drawings, it should be understood that features can be embodied in many alternate forms of embodiments. In addition, any suitable size, shape or type of elements or materials could be used.

The connector 10' is configured to mate with the same mating connector 30 as the connector 10. The IMLAs 32 have contacts 34 and an overmolded frame 16. The connector 10' uses the same housing 18. The contacts have the ends 22. In alternate embodiments, the connector 10' might not use IMLAs. The IMLAs might comprise fusible elements rather than the through hole ends 22.

Figure 3:
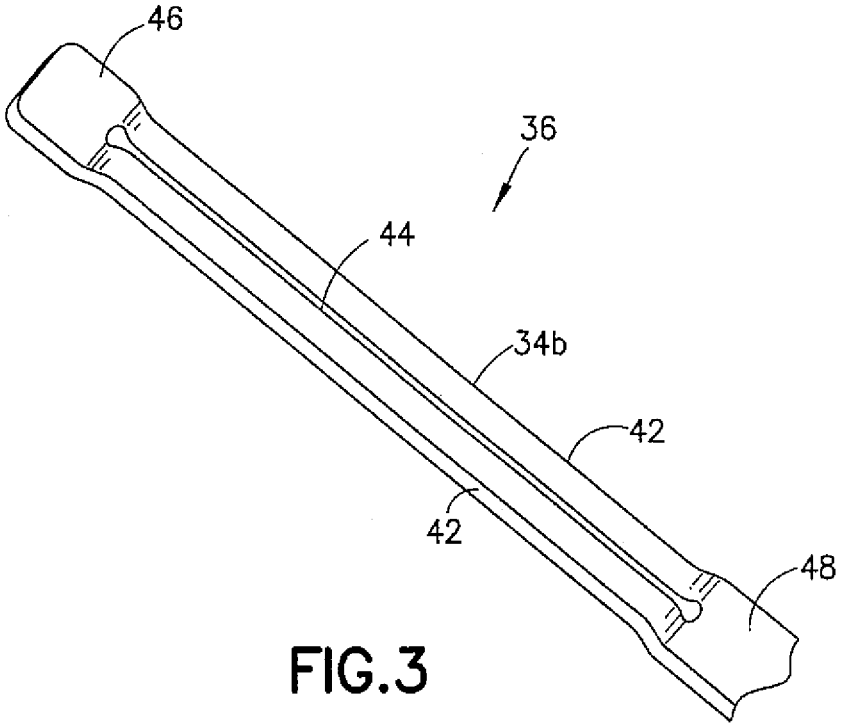
FIG. 3 is a perspective view of a male termination end of one of the ground contacts of one of the electrical connectors shown in FIG. 2.
Figure 4:
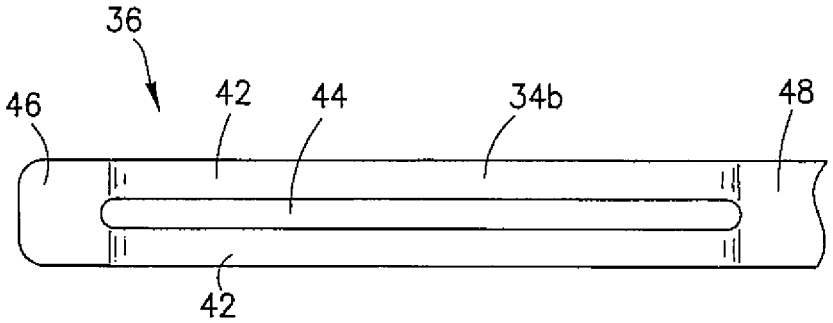
FIG. 4 is a side view of the male termination end shown in FIG. 3.
Figure 5:
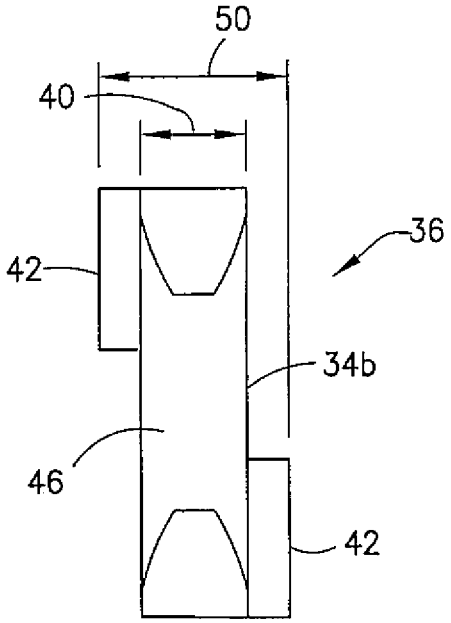
FIG. 5 is a front end view of the male termination end shown in FIGS. 3-4.
Figure 6:
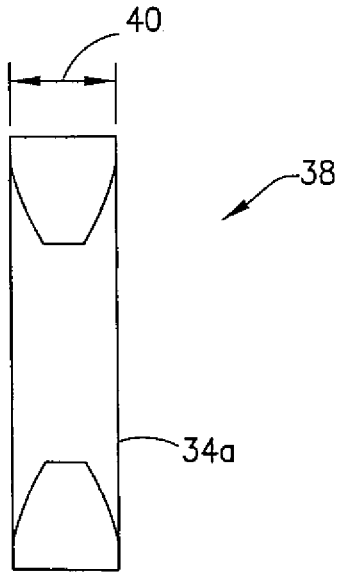
FIG. 6 is a front end view of the male termination end of one of the signal contacts of one of the electrical connectors shown in FIG. 2.

The opposite male termination ends of the contacts 34 have a different shape than the ends 20*a*, 20*b* of the conventional connector described with reference to FIG. 1. FIGS. 3-5 show the male termination end 36 of one of the ground contacts. FIG. 6 shows the male termination end 38 of one of the signal contacts. The male termination end 38 of the signal contact 34*a* has a substantially uniform thickness 40. The thickness 40 is the same as the sheet metal member used to form the lead frame. In one example, the thickness 40 is about 0.20 mm. The thickness of the sheet metal member used to form the lead frame is about 0.20 mm. Thus, different from the convention connector described with reference to FIG. 1, no material reduction is necessary at the male termination end 38 of the signal contact 34*a*.

Referring also to FIGS. 3-5 the male termination end 36 of the ground contacts 34*b* generally comprises two beams 42 and a slot 44 between the two beams. The beams 42 and slot 44 are located between front and rear sections 46, 48 of the male termination end 36. The front and rear sections 46, 48 are aligned with each other along a central axis of the male termination end 36. Because the ground contact 34*b* is formed from the same sheet metal member as the signal contacts, the thickness 40 of the front and rear sections 46, 48 is same as the thickness of the sheet metal member.

The slot 44 is formed during stamping of the lead frame. Material is removed to form the slot 44. The subsequently formed beams 42 are then deformed in opposite lateral directions to form an effective thickness 50 of the male termination end 36 between the front and rear sections 46, 48 which is larger than the thickness 40. In one type of example the thickness 50 is about 0.35 mm. The two beams 42 are substantially parallel to each other along a majority of length of the male termination end 36.

With the example described above, the sheet metal member used to form the contact lead frame for the connector 10' can be smaller in thickness that the sheet metal member used to form the contact lead frame for the connector 10. For example, instead of using a sheet metal member having a thickness of 0.35 mm, a sheet metal member having a thickness of 0.20 mm can be used. This now allows 0.20 mm thick material to act like 0.35 mm thick material. Now a header lead frame can be stamped from 0.20 thick material and still provide a 0.35 mm blade to mate with the contact receptacle beams of the mating connector 30. This can save material costs when manufacturing the connector 10' as compared to the connector 10. The connector 10' can be used with the same mating connector 30 as the connector 10. Thus, the mating contacts of the connector 30 do not need to be redesigned. This also can eliminate the need for material reduction in the die for a signal contact mating end.

In one example embodiment an electrical contact is provided comprising a male termination end 36 configured to be removably inserted into a female termination end of a mating contact, the male termination end comprising a slot 44 between two beam sections 42, where the slot comprises a section of the male termination end which has had material removed between the two beam sections, where the two beam sections are outwardly deformed in opposite directions, and where the two beam sections are substantially parallel to each other along a majority of length of the male termination end. The split beams jog outwardly, away from each other. This allows thinner stock material to mimic a thicker stock material at the mating end of the contact.

The electrical contact may be comprised of a one-piece sheet metal member. The slot may have a leading end and a trailing end which are both closed by front and rear sections of the male termination end. The front and rear sections of the male termination end may be aligned with each other along a central axis of the male termination end, and where the two beam sections are laterally offset from the central axis on opposite respective sides of the central axis. The male termination end can comprise only the two beam sections between the front and rear sections. The two beam sections can be substantially parallel to each other along over 75 percent of the length of the male termination end.

In one type of example, an electrical connector 10' may be provided comprising a housing 18; a first signal contact 20*a* connected to the housing; and a second ground contact 20*b* connected to the housing, where the first signal contact and the second ground contact are comprised from a same sheet material, where the first signal contact has a male termination end 38 at a first side of the housing with a first effective thickness 40 substantially the same as thickness of the sheet material, and where the second ground contact 20*b* has a male termination end 36 at the first side of the housing with a second effective thickness 50 which is larger than the first effective thickness 40, where the male termination end of the second ground contact comprises two beam sections 42 which are generally parallel to each other.

The two beam sections can be outwardly deformed in opposite directions. The two beam sections can be substantially parallel to each other along a majority of length of the male termination end of the second ground contact. A slot may be provided between the two beam sections, where the slot comprises a section of the male termination end of the second ground contact which has had material removed between the two beam sections. The slot may comprise a leading end and a trailing end which are both closed by front and rear sections of the male termination end of the second ground contact. The front and rear sections of the male termination end of the second ground contact may be aligned with each other along a central axis of the male termination end, and where the two beam sections are laterally offset from the central axis on opposite respective sides of the central axis. The male termination end of the second ground contact may comprise only the two beam sections between the front and rear sections. The two beam sections may be substantially parallel to each other along over 75 percent of the length of the male termination end of the second ground contact.

One example method can comprise providing a contact lead frame comprised of a sheet metal member, where the contact lead frame comprises a plurality of first signal contacts and a plurality of second ground contacts, where the first signal contacts have a male termination end with a first effective thickness which is substantially the same as thickness of the sheet metal member, and stamping a male termination end of the second ground contact, located at a same side of the lead frame as the male termination end of the first signal contacts, to form a dual beam structure having a second effective thickness which is larger than the first effective thickness, where two beams of the dual beam structure are generally parallel to each other along a majority of length of the male termination end of the second ground contact.

Stamping may comprises forming a slot between the two beams, where the slot comprises a section of the male termination end of the second ground contact having material removed between the two beams. Stamping may comprise deforming the two beams in opposite outward directions. Stamping may comprise the slot having a leading end and a trailing end which are both closed by front and rear sections of the male termination end of the second ground contact, where the front and rear sections are aligned with each other along a central axis of the male termination end of the second ground contact.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. A method comprising:

providing a contact lead frame comprising a first plurality contacts and a second plurality of contacts, wherein the first plurality of contacts have a male termination end with an effective thickness equal to a first thickness and the second plurality of contacts have male termination ends comprised of metal with the first thickness, and stamping the male termination ends of the second plurality of contacts, located at a same side of the lead frame as the male termination end of the first plurality of contacts, to form dual beam structures having a second effective thickness which is larger than the first thickness, where two beams of the dual beam structures are generally parallel to each other along a majority of length of the male termination end of the second ground contact.

2. The method according to claim 1, wherein the stamping further comprises forming a slot between the two beams, where the slot comprises a section of the male termination end of the second ground contact having material removed between the two beams.

3. The method according to claim 2, wherein the stamping further comprises deforming the two beams in opposite outward directions.

4. The method according to claim 2, wherein the stamping further comprises the slot having a leading end and a trailing end which are both closed by front and rear sections of the male termination end of the second ground contact, where the front and rear sections are aligned with each other along a central axis of the male termination end of the second ground contact.

* * * * *